US005993249A

United States Patent [19]

Benson, Jr.

[11] Patent Number: 5,993,249

[45] **Date of Patent: *Nov. 30, 1999**

[54] ELECTRIC CORD PROTECTOR

[76] Inventor: Donald Owen Benson, Jr., 10 Livery Rd., Chelmsford, Mass. 01824

[ * ] Notice: This patent issued on a continued prosecution application filed under 37 CFR 1.53(d), and is subject to the twenty year patent term provisions of 35 U.S.C. 154(a)(2).

[21] Appl. No.: 08/947,536

[22] Filed: Oct. 11, 1997

Related U.S. Application Data

[63] Continuation of application No. 08/947,536, Oct. 11, 1997.

[51] Int. Cl.[6] ..... H01R 11/00

[52] U.S. Cl. ..... 439/502; 174/136

[58] Field of Search ..... 439/502, 367; 174/136

[56] References Cited

U.S. PATENT DOCUMENTS

| | | | |
|---|---|---|---|
| 2,963,676 | 12/1960 | Sneesby et al. | 439/502 |
| 4,134,045 | 1/1979 | Quin | 439/502 |
| 4,383,811 | 5/1983 | Nishida | 425/123 |
| 4,395,053 | 7/1983 | Kalfas | 280/47.34 |
| 4,515,423 | 5/1985 | Moore et al. | 439/502 |
| 4,723,822 | 2/1988 | Merdic | 439/502 |
| 4,820,168 | 4/1989 | Scarpatetti et al. | 439/502 |
| 4,842,551 | 6/1989 | Heimann | 439/502 |

*Primary Examiner*—Khiem Nguyen
*Assistant Examiner*—T C Patel

[57] ABSTRACT

An electrical cord protector is designed to keep electric hedge trimmers and electric grass trimmers from cutting or damaging the cord. The principle behind the invention is an enlarged section of the cord so that this part of the cord will not fit between adjacent teeth of an electric hedge trimmer or an electric grass trimmer. Three methods of electrical cord protection can be used to protect the cord. In the first method, an enlarged diameter section of the cord is permanently built into the cord. This cord is then plugged into the trimmer. The second method of cord protection has an enlarged diameter section permanently built into a cord, and this cord is permanently wired into the trimmer. In the third method, a separate enlarged diameter section made from a material such as a plastic can be temporarily fastened around a section of a typical standard diameter electrical cord. The enlarged section is hollow with longitudinal ribs on the inside to accommodate different diameter typical standard diameter electrical cords. Friction of the ribs against the cord also keep the protector from slipping down the cord.

2 Claims, 7 Drawing Sheets

ELECTRIC CORD PROTECTOR

This is a continuation of application Ser. No. 08/947,536, filed Oct. 11, 1997.

BACKGROUND OF THE INVENTION

This invention relates to protecting electric cords supplying power to electric hedge trimmers and electric grass trimmers from being severed, cut, or damaged by the electric trimmers. Trimming shrubs or grass with electric trimmers is more time consuming than necessary because of the care that must be used to keep the electric cord from getting between the teeth of the trimmer. Even with care the cord can easily be cut or severed causing further expense and wasted time for the homeowner or the handy person.

DESCRIPTION OF PRIOR ART

U.S. Pat. No. 4,395,053 to Kalfas (1983) describes a method keep an electrical cord away from cutting machines such as electric lawn mowers and the like by a support bracket. Such a bracket would be impractical and would not function properly with electric hedge trimmers. The reasons are that hedge trimmers take many varied orientations during the trimming process, and the cord would unhook from the support bracket or the support bracket would get caught in the hedge being trimmed or the adjacent hedge.

U.S. Pat. No. 4,383,811 to Nishida (1983) describes a method of forming a plug and a cord protector together at one end of an electrical cord. The cord protector of Nishida helps to protect the cord from premature breaking due to the stress of the cord bending at the plug. His cord protector does not apply to protecting a cord from being cut by electric hedge or grass trimmers since his cord protector is a short section (about 1 to 2 inches long) at the cord end of the plug.

U.S. Pat. No. 4,820,168 to Scarpatetti et al. (1989) shows a conductive electrical sleeve connection for use in electrified rails. The metallic sleeve would not be suited as a cord protector because of the possible danger of electrical shock. The weight of the metal would also preclude it from use as a cord protector for hedge trimmers. U.S. Pat. No. 2,963,676 to Sneesby et al. (1960) describes an electrical cord protector for use on flat surfaces such as wider rugs and other coverings. This invention is flat all the way to a modified female outlet plug for use near the edges of rugs, and can not be used as a means to protect cords for hedge and grass trimmers. U.S. Pat. No. 4,134,045 to Quin (1979) shows a system of wires enclosed in a metal conduit. Such a metal conduit would not be suitable as a cord protector for hedge and grass trimmers because of the possibility of electrical shock, damage to the teeth of trimmers caused by the metal, and the weight of the metal necessary to enlarge the section so as not to fit between the teeth of trimmers. U.S. Pat. No. 4,842,551 to Heimann (1989) describes a connector assembly for an electrical utility box that uses conventional electrical cable. Since standard sheathed electrical cables are used, there is no modification of the sheathing for any added protection to prevent severing if the cord were used with trimmer equipment. U.S. Pat. No. 4,515,423 to Moore et al. (1985) describes a method to extend the reach of powered tools such as hedge trimmers so the user can safely work without the use of, for example, ladders. This invention does not really protect the power cord directly, but allows the user to reach hard to get at locations while keeping the cord from becoming tangled in branches. The long extension itself can be cumbersome and unsafe because of the weight of the attached trimmer.

U.S. Pat. No. 4,723,822 to Merdic (1988) describes a cord protector with an enlarged diameter section. However Merdic's protector comes in three sections making manufacturing more costly than a single section. His protector comes preinstalled on a cord and thus cannot be installed around existing extension cords of various diameters. He also describes a complicated mechanism for connecting the cord to the trimmer equipment to prevent accidental disconnection.

OBJECTIVE OF THE INVENTION

The objectives of this invention are to provide methods to keep the power cord going to electric hedge trimmers and electric grass trimmers from being severed or damaged by the trimmer. This invention shows three ways of protecting the electrical cord. These are:

1. Building the protection into a cord that is permanently attached to the hedge or grass trimmer.
2. Building the cord protection permanently into an extension cord that can be plugged into the hedge or grass trimmer.
3. Making a cord protecting device that can be temporally attached either to an existing standard extension cord that is then plugged into the hedge or grass trimmer, or attached to a cord that is permanently built in to the hedge or grass trimmer.

In addition, further objectives of the electric cord protector are to provide:

1. A cord protector that will not damage the trimmer. For example, a protective metal jacket around the cord would damage the trimmer if the metal jacket got between the teeth of the trimmer like the limb of a hedge.
2. A cord protector that is not awkward to use and will enable a user to trim hedges and grass as fast and easily with the protecting device as without it. The cord protector would even make the trimming job faster since the user would not have to be as careful with the cord.
3. A cord protector that will not necessitate changing the method of using hedge or grass trimmers.
4. A cord protector that will not be costly to manufacture and to purchase for the consumer.
5. A cord protector that is simple to use and install or remove.
6. A cord protector that when removed from around the standard extension cord leaves the standard extension cord as it was before the cord protector was installed.

REFERENCE NUMERALS IN DRAWINGS

Figure 1A:
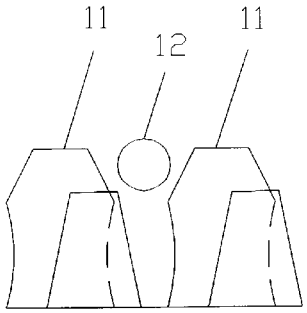
FIG. 1A. shows a standard extension cord between two teeth of a hedge trimmer about to be cut.

10 a typical hedge trimmer
11 two adjacent cutting teeth of the hedge trimmer
12 a typical conventional extension cord
14 rear handle of the hedge trimmer
20 an extension cord with permanently built-in cord protection
21 leader part of the extension cord going from the protected part of the cord to the female plug
22 the enlarged diameter section of the cord that is the protected part of the extension cord
23 leader part of the extension cord going from the protected part of the cord to the male plug
30 built-in cord protector for a cord permanently attached to a hedge trimmer
31 leader part of the cord going from the hedge trimmer to the protected part of the cord
32 an enlarged diameter section of the cord that is the protected part of the cord.
33 leader part of the cord going from the protected part of the built-in cord to the male plug
34 a standard extension cord plugged into the protected built-in cord
40 a cord protector that can be placed temporarily around a standard diameter cord.
41 rounded edges of the cord protector so that the protector will not easily get caught in the limbs and branches of shrubs being trimmed
42 male part of a fastening method to hold the cord protector around the cord being protected
43 female part of a fastening method to hold the cord protector around the cord being protected
44 soft ribs along the inside length of the cord protector to accommodate different diameter standard electrical cords and to provide friction so the cord protector will not slip along the cord
51 a standard extension cord with an attachable cord protector around the standard extension cord
71 a standard diameter cord permanently built into a hedge trimmer
81 location where two attachable cord protectors have been concatenated to extend the length of the extension cord protected

DESCRIPTION OF THE PREFERRED EMBODIMENT

Figure 1:
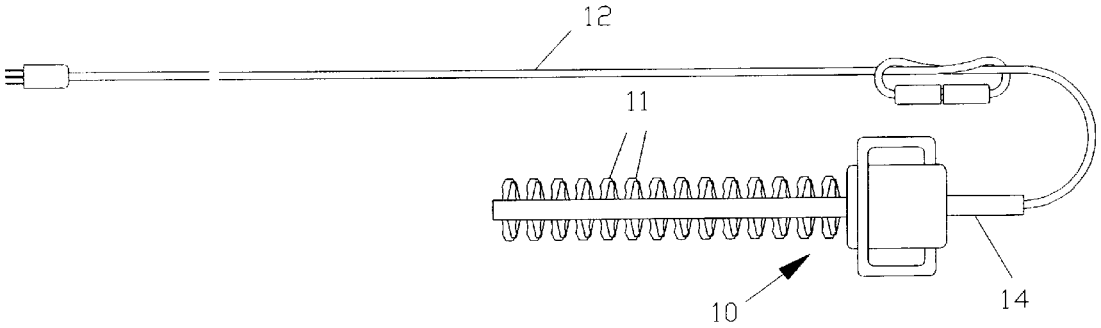
FIGURE 1 Prior Art
FIG. 1. shows a typical hedge trimmer with a standard, convention al extension cord and is not part of the invention.

The basis of this invention is to make the part of the cord that is most likely to get between the teeth of the hedge or grass trimmer larger in diameter than the distance between adjacent teeth of the trimmer. Typical standard extension cords 12 can easily get between adjacent teeth 11 of typical hedge trimmers 10 as shown in FIG. 1A and FIG. 1 and get cut or damaged. This invention describes three methods to protect cords supplying electrical power to hedge or grass trimmers with enlarged diameter sections.

Figure 2B:
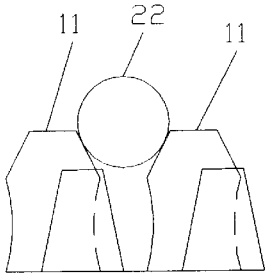
FIG. 2B. shows that the enlarged diameter section of the cord can rot get between the teeth of a hedge trimmer to get cut.
Figure 2A:
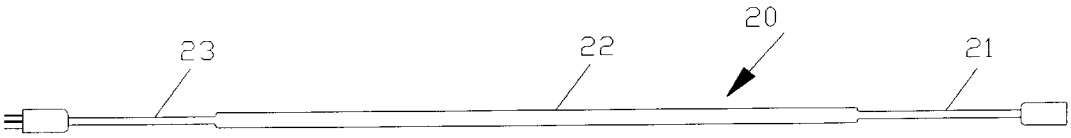
FIG. 2A. shows the enlarged diameter section of the cord in relation to the rest of the cord.
Figure 2:
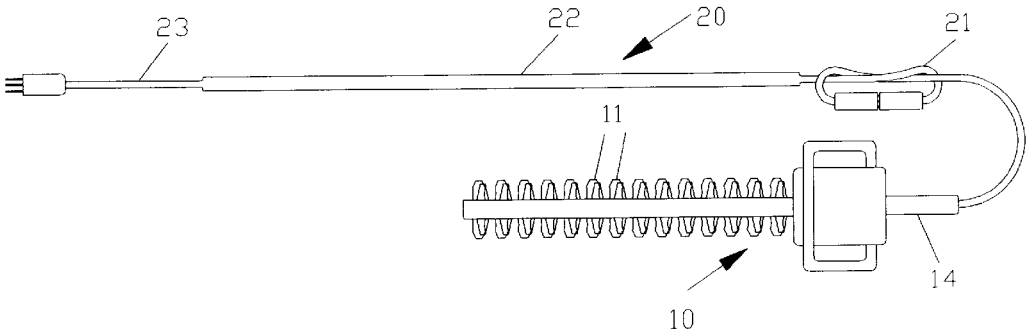
FIG. 2. shows a cord protector made as permanent part of an extension cord with the cord plugged into a hedge trimmer.

The first type of cord protector disclosed in this invention protects a cord from being cut or damaged with an enlarged diameter section 22 permanently built in to an extension cord 20 as shown in FIG. 2A. This extension cord 20 with the enlarged diameter 22 is plugged into a hedge trimmer 10 shown in FIG. 2. The enlarged diameter section 22 is large enough so that it will not fit deeply enough between adjacent teeth 11 of the hedge trimmer to get cut as shown in FIG. 2B. A leader section 21 of the extension cord goes from the protected part 22 to the female plug of the cord. The leader section 21 has three purposes. One purpose of the leader is to enable the user to make a connecting knot to the short cord coming from the hedge trimmer 10 shown in FIG. 2. This connecting knot keeps the plug connection from pulling apart if the cord gets caught, for example, in the branches of the hedge. Some hedge trimmers do not have the short cord as shown in FIG. 2, but instead have a male plug built in the rear of the hedge trimmer. For this type of hedge trimmer a second purpose of the leader 21 is to connect the cord to the trimmer the same way as a standard extension cord would connect to the trimmer. A third purpose of the leader 21 is to allow the cord to easily bend at the leader section 21 so that only the protected part 22 of the cord can come in contact with the teeth of the trimmer and not the smaller, standard diameter sections of the extension cord 23 and 21. The leader section of the cord 21, being of smaller diameter, is not as stiff as the enlarged section of the cord 22 so the cord will more easily bend at the leader section. The leader 23 of the other end of the cord, connecting the enlarged section 22 to the male plug, is standard extension cord diameter which will keep the cost of materials down and weight down, and will allow a knot connection to another extension cord if necessary.

Typical dimensions for the protected part of the cord 22 are diameters ranging from approximately ⅝ inch to approximately 1 inch and lengths ranging from approximately three feet to approximately six feet. Leader 21 is approximately 12 inches long with a diameter of a typical standard extension cord of approximately ⅜ inch. Leader 23 is of the same diameter as leader 21 and its length can vary from approximately 12 inches to as long as any typical standard extension cord. However a minimum length of approximately 12 inches for leader 23 is the most practical since any length standard extension cord then can be attached to the protected cord. The protected cord 20 can be sold more cheaply as a short extension cord add-on to a longer standard extension cord that the homeowner would probably already have. The enlarged diameter section 22 of the cord can be made of the same plastic material as a typical standard extension cord, or sheathed with that material while the inside of the enlarged diameter is made with a cheaper material such as polystyrene plastic.

Figure 3B:
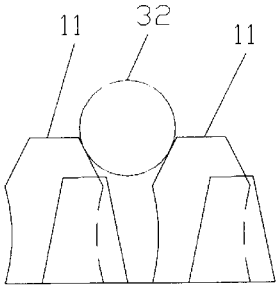
FIG. 3B. shows that the enlarged diameter section of the permanently attached cord protector can not get between the teeth of a hedge trimmer to get cut.
Figure 3A:
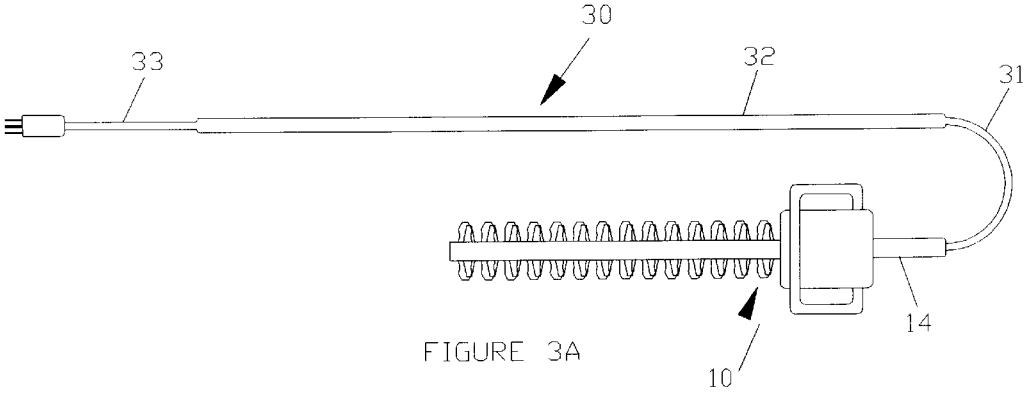
FIG. 3A. shows the enlarged diameter section of the permanently attached cord protector in relation to the other parts of the cord.
Figure 3:
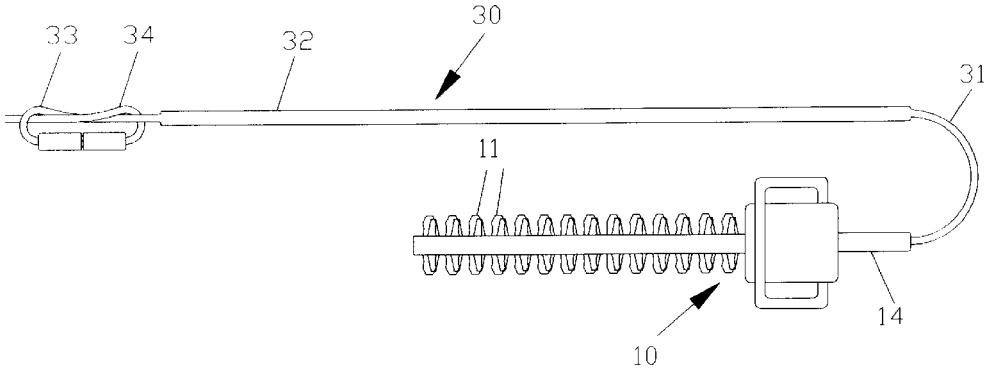
FIG. 3. shows a cord protector permanently built into a hedge trimmer with the built-in cord plugged into a conventional extension cord.

The second method in which this invention will protect the electrical cord from being cut or damaged by a hedge trimmer builds in the protected cord 30, with its enlarged diameter protection 32, permanently to the hedge trimmer 10 as shown in FIG. 3A. The permanent attachment of the cord to the trimmer normally would be done by the manufacturer of the hedge trimmer. FIGS. 3 and 3A show the built in cord protector coming from the rear handle 14 of the hedge trimmer. Leader 33 is approximately 12 inches long so that cord 30 can be attached to a longer standard extension cord 34 with a connecting knot shown in FIG. 3. FIG. 3B shows that the enlarged diameter section 32 of the cord 30 can not be cut by adjacent teeth 11 of the hedge trimmer. The diameter of the enlarged section 32 would be specified by the manufacturer of his particular model hedge trimmer and would large enough so that the enlarged section 32 would not be cut or damaged by the trimmer. The length of the protected section 32 would be approximately three feet to approximately six feet. Leader 31 would be approximately 12 inches long, and the diameters of both leaders 31 and 33 would be that of a typical standard extension cord diameter, that is, approximately ⅜ inch. The enlarged diameter section 32 of the cord can be made of the same plastic type material as a standard extension cord, or sheathed with that material while the inside of the enlarged diameter is made with a cheaper material such as polystyrene plastic.

Figure 5:
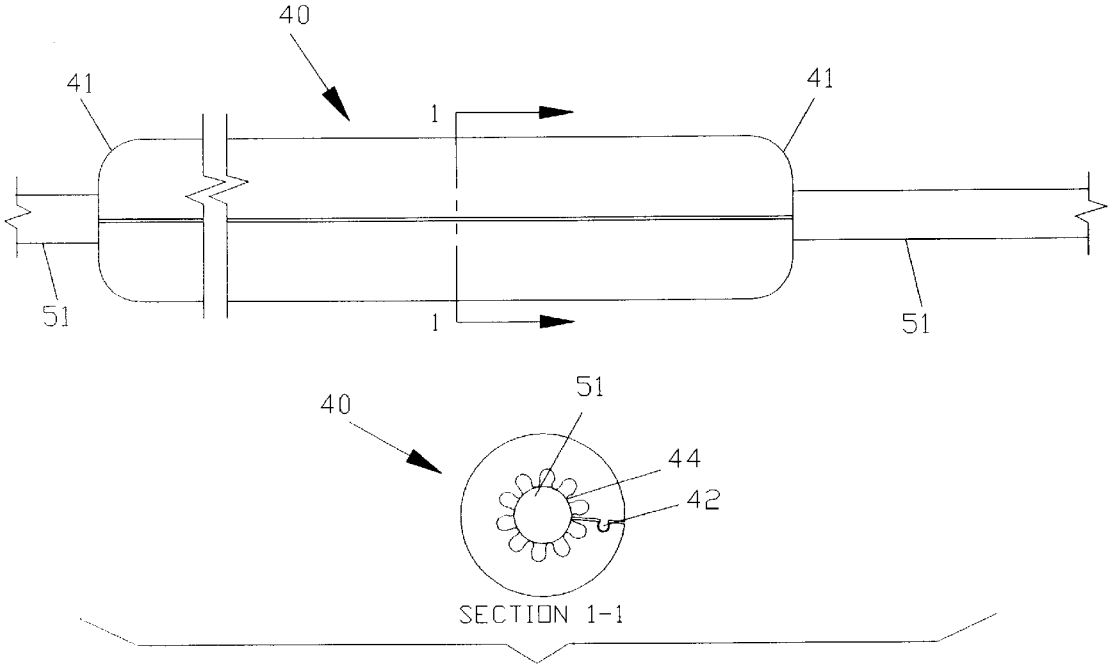
FIG. 5. shows the attachable cord protector around a standard extension cord and a cross section of the cord protector around a standard cord.
Figure 4:
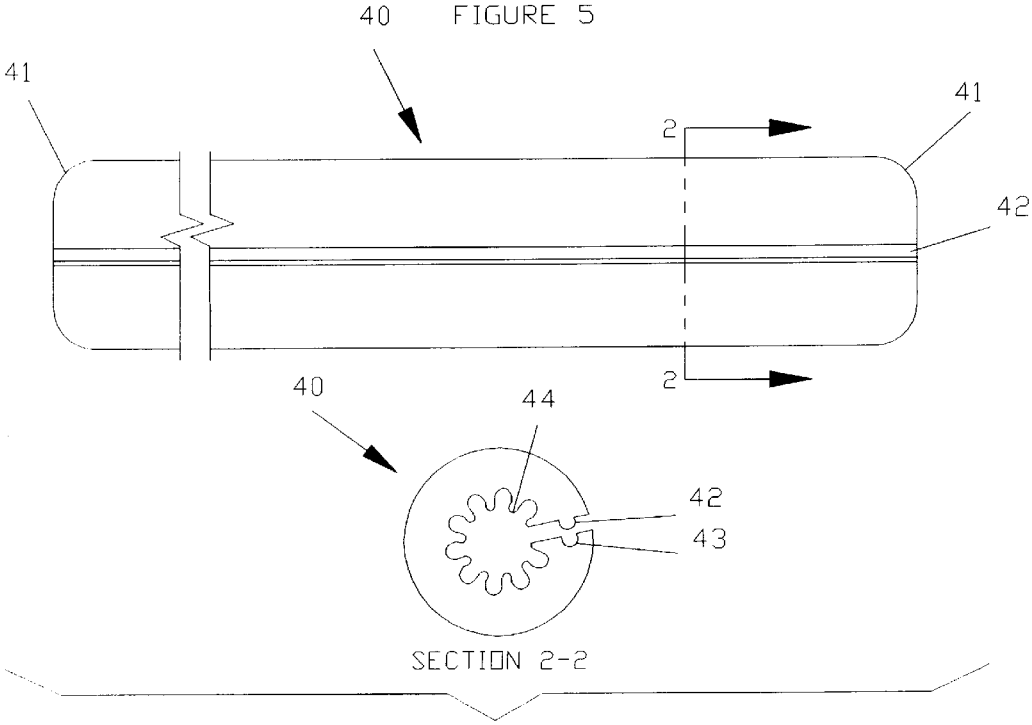
FIG. 4. shows a cord protector that can be attached to a conventional extension cord and a cross section of the cord protector.

The third method in which this invention protects an electrical cord from hedge or grass trimmer damage is now described. The cord protector in this method can be temporally attached either to an existing standard extension cord that is then plugged into the hedge or grass trimmer, or attached to a cord that is permanently built in to the hedge or grass trimmer. An attachable cord protector shown in FIG. 4 can be attached to any standard extension cord 51 as shown in FIG. 5. In this way a homeowner can use any standard extension cord and add the attachable cord protector 40 to the cord when he is using his hedge or grass trimmer. FIG. 4 shows an attachable cord protector 40 without an extension cord through it. Ribs 44, shown in section A—A of FIG. 4., along the inside length of the cord protector can be compressed to accommodate varying diameter extension cords. These ribs also provide friction so the cord protector will not slip down the cord if a branch catches an end of the protector. Rounded corners 41 also aid in preventing branches from catching the ends of the protector and moving the protector along the cord. The cord 51 is inserted along the longitudinal opening of the cord protector 40, and the protector is secured shut around the cord by pushing longitudinal male protuberance 42 into female trough 43. FIG. 5 shows the cord protector 40 secured around an extension cord 51. Section B—B of FIG. 5 shows a cross section of the cord protector around the cord 51 with the ribs 44 pressing against extension cord 51.

Figure 6B:
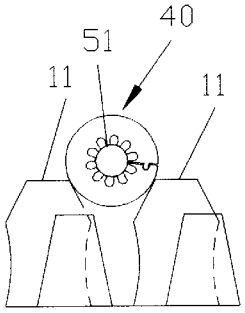
FIG. 6B. shows the enlarged diameter section of material prevents the cord from getting between the teeth of a hedge trimmer to get cut.
Figure 6A:
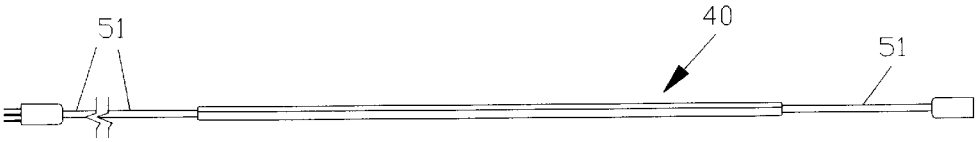
FIG. 6A. shows the position of an attachable cord protector that is attached temporarily around a standard extension cord.
Figure 6:
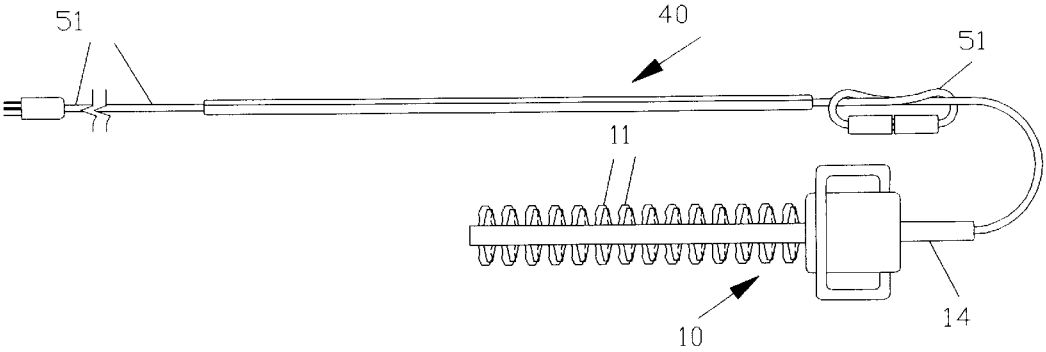
FIG. 6. shows an attachable cord protector that is attached temporarily around a standard extension cord and plugged into a hedge trimmer.

FIG. 6A shows correct placement of the attachable cord protector 40 secured around a standard extension cord 51. FIG. 6 shows the protected extension cord plugged into a hedge trimmer 10 with a knotted connection. FIG. 6B shows that the cord protector does indeed protect the extension cord from being cut or damaged by the hedge trimmer since the protector will not fit between adjacent teeth 11 of the hedge trimmer.

Figure 7A:
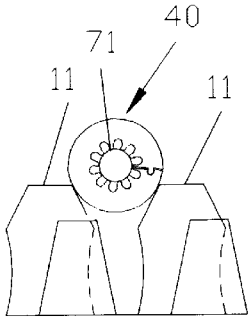
FIG. 7A shows the enlarged diameter section of material prevents the cord from getting between the teeth of a hedge trimmer to get cut.
Figure 7:
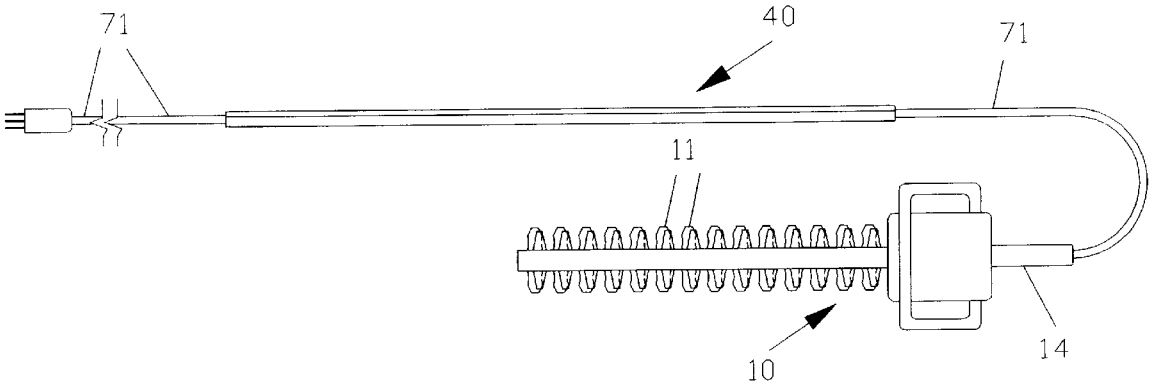
FIG. 7 shows an attachable cord protector that is attached temporarily around a standard diameter cord permanently built into a hedge trimmer.

The attachable cord protector 40 can also protect a typical standard diameter electrical cord 71 that is permanently built in to a hedge trimmer as shown in FIG. 7. To attach the cord protector 40, the electrical cord 71 built in to the hedge trimmer must be long enough to hold the protector, that is, approximately three feel or longer. This cord is longer than a typical short cord extension permanently built in to a typical hedge trimmer shown in FIGS. 1 or 2.

Figure 8:
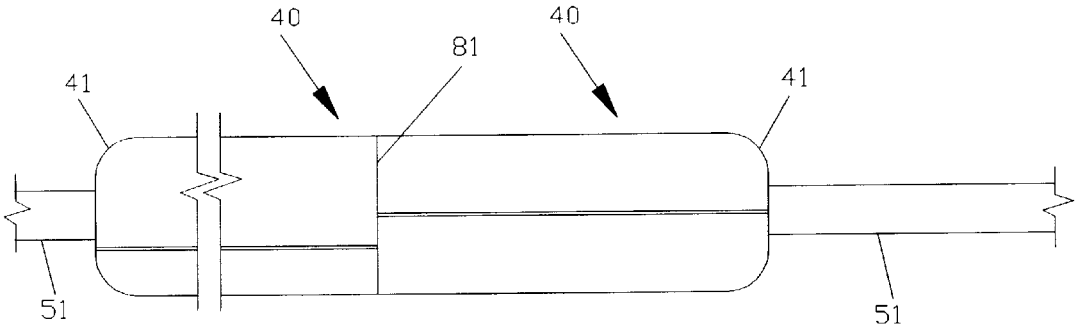
FIG. 8 shows two cord protectors concatenated by cutting them and placing them next to each other to extend the protection further down the length of the cord.

Since the cord protector 40 is made of a plastic material it can be cut into sections and juxtapositioned together with two different sections meeting at location 81 as shown in FIG. 8. In this way the protected part of the cord may be made as long as desired.

Although specific terms are used in the above description for the sake of clarity, these terms are intended to refer only to the particular structure of my invention selected for illustration in the drawings, and are not intended to define or limit the scope of the invention. Thus the scope of the invention should be determined by the following claims and their legal equivalents, rather than by the examples given.

I claim:

1. An electrical extension cord including a cord protector for an electric hedge trimmer or electric grass trimmer, comprising:

(a) an enlarged diameter section permanently molded extending along substantial length and fixed to said electrical extension cord, whereby said enlarged diameter section will not fit between adjacent teeth of the electric hedge trimmer or electric grass trimmer, and (b) a first leader section of said electrical extension cord that is not enlarged and extends from a first end of said enlarged diameter section to a female plug of said electrical extension cord whereby said electrical extension cord can easily bend at said first leader section so that if the trimmer teeth come in contact with the cord it will usually contact the enlarged diameter section and not the first leader section of said electrical extension cord, and whereby said first leader section can make a connecting knot with a male plug on the trimmer to prevent accidental disconnection of said cord; and (c) a second leader section of said electrical extension cord that is not enlarged and extends from a second end of said enlarged diameter section to a male plug of said electrical extension cord whereby said second leader section can make a connecting knot with another extension cord, and whereby said second section can be short resulting in a short extension cord that is inexpensive to manufacture and purchase.

2. An electrical cord including a cord protector permanently attached to a hedge trimmer or grass trimmer comprising:

(a) an enlarged diameter section permanently molded extending along substantial length and fixed to said electrical cord whereby said enlarged diameter section will not fit between adjacent teeth of the electric hedge trimmer or electric grass trimmer, and (b) a first leader section of said electrical cord that is not enlarged and extends from a first end of said enlarged diameter section to said trimmer whereby said electrical cord can easily bend at said first leader section so that if trimmer comes in contact with the cord it will usually contact the enlarged diameter section and not the first leader section of said electrical cord, and (c) a second leader section of said electrical cord that is not enlarged and extends from a second end of said enlarged section to a male plug of said electrical cord whereby said second leader section can make a connecting knot with another extension cord, and whereby said second leader section can be short resulting in a short cord that is inexpensive to manufacture and purchase.

* * * * *